US005950716A

United States Patent [19]

Appelquist et al.

[11] Patent Number: 5,950,716

[45] Date of Patent: Sep. 14, 1999

[54] OIL COOLER

[75] Inventors: Agne Appelquist; Glenn Hermansson, both of Solvesborg, Sweden

[73] Assignee: Valeo Engine Cooling AB, Solvesborg, Sweden

[21] Appl. No.: 08/165,313

[22] Filed: Dec. 10, 1993

[30] Foreign Application Priority Data

Dec. 15, 1992 [SE] Sweden ..... 9203776

[51] Int. Cl.[6] ..... F28F 13/12; F28D 7/10

[52] U.S. Cl. ..... 165/109.1; 165/140; 165/154; 165/916

[58] Field of Search ..... 165/154, 109.1, 165/916, 140; 138/38

[56] References Cited

U.S. PATENT DOCUMENTS

| | | | |
|---|---|---|---|
| 1,977,809 | 10/1934 | Sutter | 165/154 |
| 3,339,260 | 9/1967 | Burne et al. | 29/890.036 |
| 3,525,391 | 8/1970 | Day | 165/109.1 X |
| 3,664,928 | 5/1972 | Roberts | 165/165 X |
| 3,834,448 | 9/1974 | Cooksley | 165/154 X |
| 4,194,560 | 3/1980 | Matsuzaki | 165/916 X |
| 4,250,866 | 2/1981 | Telkes | 165/154 X |
| 4,372,374 | 2/1983 | Lee | 165/154 X |
| 4,690,211 | 9/1987 | Kuwahara et al. | 165/177 |

FOREIGN PATENT DOCUMENTS

| | | | |
|---|---|---|---|
| 679285 | 7/1939 | Germany | 165/154 |
| 33091 | 2/1983 | Japan | 165/154 |
| 46588 | 2/1989 | Japan | 165/154 |
| 327455 | 1/1958 | Switzerland | 165/154 |
| 1087760 | 4/1984 | U.S.S.R. | 165/109.1 |
| 977579 | 12/1964 | United Kingdom | 165/154 |
| 2159265 | 11/1985 | United Kingdom | 165/109.1 |

*Primary Examiner*—Leonard Leo
*Attorney, Agent, or Firm*—Morgan & Finnegan, L.L.P.

[57] ABSTRACT

An oil cooler for motor vehicles, having an outer tube and an inner tube which is disposed within the outer tube and whose outer surface, together with the inner surface of the outer tube, forms an annular channel, sealed in both ends, for feeding oil to be cooled, from an inlet at first ends of the tubes to an outlet at second ends of the tubes, a means provided in the annular channel for ensuring heat transfer from the passing oil to the surrounding tube walls, and a turbulence-generating means provided on the outer surface of the outer tube for a coolant, in which the oil cooler is submerged, the turbulence-generating means consisting of cup-shaped dimples or bump-like projections formed on the outer surface of the outer tube.

14 Claims, 1 Drawing Sheet

OIL COOLER

The present invention relates to an oil cooler for motor vehicles and more specifically to an oil cooler having an inner tube disposed within an outer tube and whose outer surface, together with the inner surface of the outer tube, forms an annular channel.

When cooling oil used in a vehicle, for instance gear oil, motor oil, oil for hydraulic devices etc., use is often made of an oil cooler utilising the liquid in the radiator of the vehicle. Such a conventional oil cooler, representing the general background art, consists of a double-walled tube having an outer wall and an inner wall. The annular channel formed between the outer and inner walls accommodates a surface-enlarging means which improves the heat transfer. At one end of the tube, an oil inlet is connected to the channel, while an oil outlet is connected to it at the other end of the tube. The oil cooler is placed in a tank which is part of the radiator system of the vehicle, such that the coolant in the radiator flows both inside the inner wall of the tube and outside and round the outer tube wall.

Since oil coolers in modern vehicles must be able to cool off a considerable amount of heat without taking up too much space, the above-mentioned basic concept is subjected to further development.

It is of the utmost importance that the heat transfer from the oil via the surface-enlarging means to the tube walls and thence to the medium flowing outside the tube be as effective as possible, considering, of course, practical aspects of manufacture.

The development work which has long been conducted has been primarily focused on developing the surface-enlarging means within the tube channel with a view to maximising the heat transfer from the oil to the channel walls without an excessive pressure drop of the oil and without increasing the dimensions of the oil cooler.

The problem of improving the heat transfer from the tube walls to the ambient coolant has however not found a fully satisfactory solution. One approach which, among other things, aims at solving this problem is that disclosed in the U.S. Pat. No. 4,086,959, which is hereby incorporated by reference, and in which an oil cooler designed in the same way as the above-mentioned basic construction comprises a double-walled tube having an annular channel for the flowing oil, and means provided in the channel for increasing the heat-transfer surface and increasing the turbulence in the oil passing by. The outer tube is corrugated, i.e. provided with helical depressions over essentially its entire length. The corrugated surface creates an increased turbulence in the coolant passing by, thus increasing the heat transfer by about 10% as compared with an oil cooler having a smooth surface. This construction however suffers from certain drawbacks, the main one being the considerable pressure drop of the oil flowing through the channel, which adversely affects the cooling system. Moreover, this oil cooler is complex and expensive to manufacture, for instance because of the corrugated surface of the outer tube.

In view of the shortcomings described above, there is an obvious need of improvements in the oil cooler described above.

One object of the present invention thus is to overcome the above-mentioned drawbacks and provide an oil cooler exhibiting improved heat-transfer capacity and lower pressure drop as compared with the prior art.

Another object is to provide an oil cooler which is easy and inexpensive to manufacture.

A special object is to provide a flexible oil cooler which can be readily adapted to varying demands that are placed on different oil-cooling systems, in respect of maximum permissible pressure drop and heat-transfer capacity, where these demands depend on the other components of the system.

These objects have now been achieved by means of an oil cooler of the type described by way of introduction.

Other features of the invention appear from the appended dependent claims which recite preferred embodiments thereof.

The invention confers a number of advantages over the oil cooler disclosed in U.S. Pat. No. 4,086,959.

Practical tests have shown that the increased turbulence in the coolant flowing through and round the tube improves the heat transfer by about 20% in relation to an oil cooler having a smooth outer surface, which means that the oil cooler according to the invention exhibits significantly improved heat-transfer properties as compared with the oil cooler disclosed in U.S. Pat. No. 4,086,959. The special design of the outer tube also makes the pressure drop that always occurs in the oil flowing through the channel smaller than in the oil cooler mentioned above.

A currently preferred embodiment will be described hereinafter by way of a non-restricting example with reference to the accompanying drawing.

Figure 1:
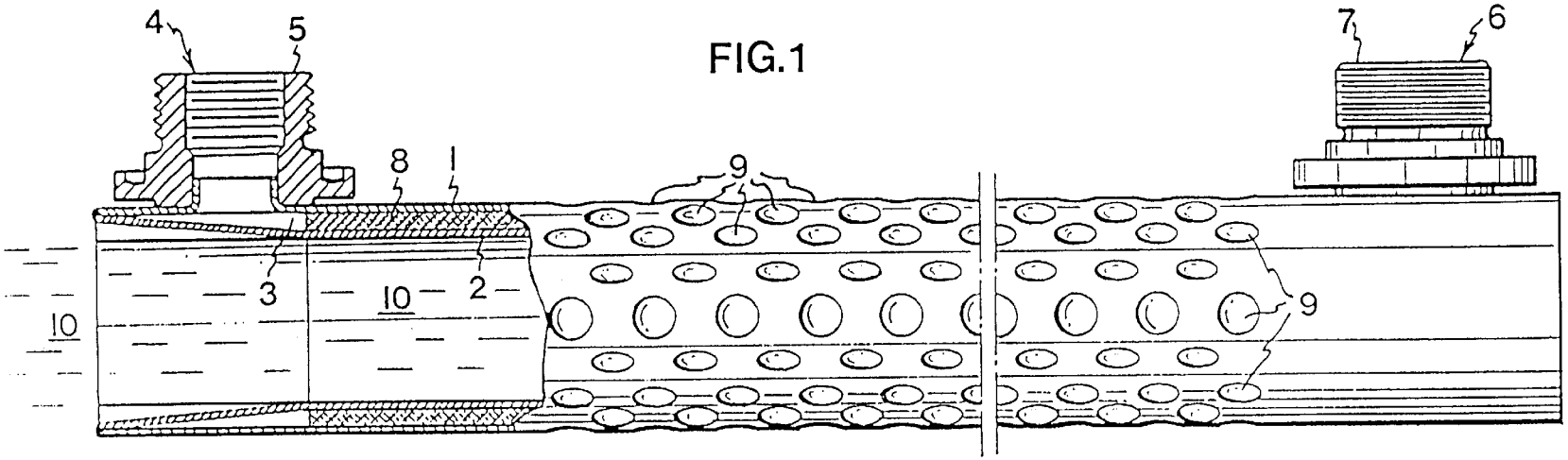
FIG. 1 is a part-sectional side view of an oil cooler according to the invention.
Figure 2:
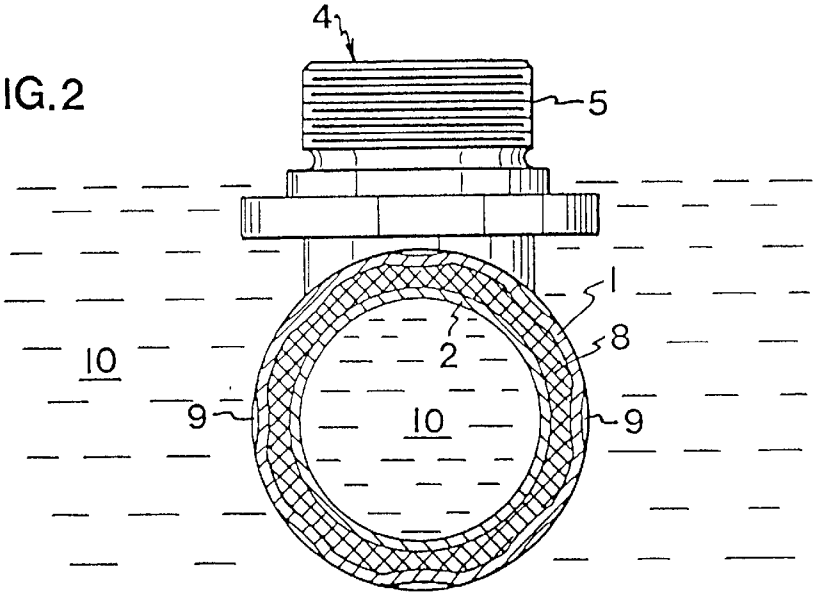
FIG. 2 is a cross-section of the oil cooler.

In FIGS. 1–2, there is shown a preferred embodiment of an oil cooler according to the invention. The oil cooler, which is intended to be inserted in a tank being part of the radiator system of a vehicle, is composed of an outer tube 1 and an inner tube 2 which is disposed in the outer tube 1 and whose outer surface, together with the inner surface of the outer tube 1, forms an annular channel 3. The channel 3, which is sealed in both ends, is intended to conduct oil to be cooled. One end of the channel has an inlet 4 consisting of a conventional nipple 5. The oil is conducted through this nipple into the channel, flows therethrough and leaves through an outlet 6 consisting of a nipple 7 which is provided at the other end of the channel 3. The annular channel 3 accommodates a surface-enlarging means 8 which not only creates turbulence in the flowing oil but also increases the heat-transfer surface, thus promoting the heat transfer from the oil to the tube walls.

The outer tube is provided with a large number of cup-shaped dimples 9 which are disposed throughout substantially the entire length of the outer tube 1 and over the entire circumference thereof. The dimples 9 increase the turbulence in a coolant 10 flowing outside the outer tube. The dimples 9, which are ciruclar and have a diameter of 6 mm, are disposed in 16 rows in the longitudinal direction of the outer tube 1, these rows being evenly distributed over the circumference of the tube 1. The distance between the centres of the dimples 9 in the same row is 11.5 mm, while the dimples of two adjacent rows are offset from each other 5.75 mm in the longitudional direction.

The oil cooler is manufactured and assembled as follows.

The inner tube 2 is cut to the desired length, and the surface-enlarging means 8 is applied round the circumference of this tube along substantially the entire length thereof. Similarly, the outer tube 1 is cut to the desired length, and holes are made therein for the nipples 5, 7. The nipples are fixed at the holes in the outer tube 1 by welding or brazing. The inner tube 2 is then inserted in the outer tube 1, whereupon the inner tube 2 is expanded against the inner side of the outer tube 1, so as to clamp the inner tube 2 within the outer tube 1. The ends of the tubes are then welded together to seal the tubes with respect to each other. Finally, the cup-shaped dimples 9 are provided in the outer surface of the outer tube by means of a press tool.

The cup-shaped dimples distributed over the outer surface of the outer tube thus increase the turbulence of the coolant flowing outside the outer tube, thus promoting the heat transfer from the tube walls to the surroundings, without causing any excessive pressure drop of the oil. This improves the capacity of the oil cooler to cool the hot oil.

The invention also offers other advantages which appear from the embodiment described above.

The oil cooler is easy and inexpensive to manufacture since it consists of standard components. No special outer tube is required, in that this tube is processed after assembly of the oil cooler. The depth of the cup-shaped dimples is decisive of what increase in heat transfer is achieved and the extent of the additional pressure drop produced, i.e. a deeper dimple increases the heat transfer at the expense of an increased pressure drop. Since the dimples are made after assembly of the oil cooler, the performance of the cooler can be easily adapted to the remaining components of the radiator system. For instance, if the system includes an efficient oil pump, the dimples could be made deeper, since the system can then withstand a greater pressure drop of the oil.

To conclude, it should be pointed out that essentially the same favourable effects are achieved by similarly forming the outer surface of the outer tube with bump-like projections instead of cup-shaped dimples. It is also conceivable to use a combination of projections and dimples. Also, it should be noted that similar dimples and/or bumps 11 may advantageously be provided also on the inner surface of the inner tube, i.e. facing the channel through which the surrounding coolant flows.

What is claimed is:

1. An oil cooler for motor vehicles, having an outer tube and an inner tube which is disposed within the outer tube and whose outer surface, together with the inner surface of the outer tube are spaced from each other to establish a gap therebetween and thus to form an annular channel, sealed in both ends, for feeding oil to be cooled, from an inlet at a first end of the tubes to an outlet at a second end of said tubes, a means provided in the annular channel for ensuring heat transfer from the passing oil to the surrounding tube walls, and a turbulence-generating means provided on the outer surface of the outer tube for a coolant, in which the oil cooler is submerged, characterized in that the turbulence-generating means consists of cup-shaped dimples formed on the outer surface of the outer tube, said cup-shaped dimples also being spaced from said outer surface of said inner tube.

2. An oil cooler as claimed in claim 1, comprising cup-shaped dimples formed on the inner surface of the inner tube, said inner surface dimples being spaced from said inner surface of said outer tube.

3. An oil cooler as claimed in claim 1 comprising cup-shaped dimples that are circular and have a diameter of about 6 mm.

4. An oil cooler as claimed in claim 3, in which the distance between the centers of two adjacent cup-shaped dimples in the same row comprises a distance of about 11.5 mm.

5. An oil cooler as claimed in claim 1, comprising cup-shaped dimples that are disposed in a number of rows in the longitudinal direction of the tubes, said rows being evenly distributed over the circumference of the outer tube.

6. An oil cooler as claimed in claim 1, comprising cup-shaped dimples of two adjacent rows, said respective dimples in each of said rows being offset relative to each other.

7. An oil cooler as claimed in claim 6, comprising cup-shaped dimples of two adjacent rows in which each of the adjacent dimples in the respective rows are offset about 5.75 mm from each other.

8. An oil cooler for motor vehicles, having an outer tube and an inner tube which is disposed within the outer tube and whose outer surface, together with the inner surface of the outer tube are spaced from each other to establish a gap therebetween and thus to form an annular channel, sealed in both ends, for feeding oil to be cooled, from an inlet at a first end of said tubes to an outlet at a second end of the tubes, a means provided in the annular channel for ensuring heat transfer from the passing oil to the surrounding tube walls, and a turbulence-generating means provided on the outer surface of the outer tube for a coolant, in which the oil cooler is submerged, characterized in that the turbulence-generating means consists of bump-like projections formed on the outer surface of the outer tube, said bump-like projections also being spaced from said outer surface of said inner tube.

9. An oil cooler as claimed in claim 8, comprising bump-like projections formed on the inner surface of the inner tube, said inner surface bumps being spaced from said inner surface of said outer tube.

10. An oil cooler as claimed in claim 8 comprising bump-like projections that are circular and have a diameter of about 6 mm.

11. An oil cooler as claimed in claim 10, in which the distance between the centers of two adjacent bump-like projections in the same row comprises a distance of about 11.5 mm.

12. An oil cooler as claimed in claim 8, comprising bump-like projections that are disposed in a number of rows in the longitudinal direction of the tubes, said rows being evenly distributed over the circumference of the outer tubes.

13. An oil cooler as claimed in claim 8, comprising bump-like projections of two adjacent rows, said respective bump-like projections in each of said rows being offset with respect to each other.

14. An oil cooler as claimed in claim 13, comprising bump-like projections of two adjacent rows in which each of the adjacent bumps in the respective rows are offset about 5.75 mm from each other.

* * * * *